United States Patent [19]

McWilliams

[11] 4,388,520

[45] Jun. 14, 1983

[54] ELECTRIC COOKERS WITH WARNING LIGHTS

[75] Inventor: Joseph A. McWilliams, Droitwich, England

[73] Assignee: Micropore International Ltd., Droitwich, England

[21] Appl. No.: 289,134

[22] Filed: Aug. 3, 1981

[30] Foreign Application Priority Data

| | | | |
|---|---|---|---|
| Aug. 13, 1980 | [GB] | United Kingdom | 8026463 |
| Feb. 7, 1981 | [DE] | Fed. Rep. of Germany | 3104265 |
| Feb. 9, 1981 | [GB] | United Kingdom | 8103869 |

[51] Int. Cl.[3] ..... H05B 3/76

[52] U.S. Cl. ..... 219/464; 219/353; 219/449; 219/460; 219/457; 219/512; 219/506; 337/382; 337/394

[58] Field of Search ..... 219/353, 554, 445, 446, 219/448, 449, 452, 457, 459, 460, 464, 466, 467, 505, 494, 506, 512, 513; 337/354, 382, 383, 386, 390, 393, 394

[56] References Cited

U.S. PATENT DOCUMENTS

| | | | |
|---|---|---|---|
| 3,026,402 | 3/1962 | Russell | 219/441 |
| 3,784,788 | 1/1974 | Fourny | 219/441 |
| 4,243,874 | 1/1981 | Fischer | 219/467 |
| 4,327,280 | 4/1982 | McWilliams | 219/464 |

FOREIGN PATENT DOCUMENTS

| | | |
|---|---|---|
| 690197 | 4/1953 | United Kingdom . |
| 2003005 | 2/1979 | United Kingdom . |
| 1577367 | 10/1980 | United Kingdom . |

*Primary Examiner*—Volodymyr Y. Mayewsky
*Attorney, Agent, or Firm*—Browdy and Neimark

[57] ABSTRACT

A glass ceramic hob electric cooker is provided on each of the radiant heaters thereof with a temperature responsive element such as a bi-metallic switch or a thermistor, which element is arranged adjacent to or within an opening which communicates with an enclosed chamber formed between the heater and the underside of the glass ceramic cooking surface. When the heating element of the heater is energized, hot air issues from the opening and impinges on the temperature responsive element thus heating said element. A warning lamp is connected with the temperature responsive element to indicate when said element and thus the glass ceramic cooking surface is at or above a safe touching temperature of 50° to 60° C.

18 Claims, 6 Drawing Figures

ELECTRIC COOKERS WITH WARNING LIGHTS

BACKGROUND OF THE INVENTION

The present invention relates to an electric cooker having means for warning the user when one or more of the cooking surfaces is above a safe touching temperature, and more particularly, but not exclusively, the present invention relates to glass ceramic top cookers having such warning means.

DESCRIPTION OF PRIOR ART

Problems can arise with electric cookers if there is no visible or other indication when the temperature of the cooking surface becomes too hot to touch without causing burns. Most cookers have a pilot light system to indicate when any of the heaters is electrically energised, but this does not give an adequate indication of a hazardous surface temperature, particularly in the case of glass ceramic top cookers. The pilot light is illuminated immediately the heater is switched on, but the cooking surface will take some 15 to 50 seconds to reach a hazardous temperature, for example 50° to 60° C. More importantly, as soon as the heater is switched off, the pilot light is turned off, but the cooking surface remains hot for some time, and depending on the construction of the cooker and the time for which the heater has been operating, it can take from 20 to 80 minutes for the cooking surface to cool down sufficiently for it to be touched with safety.

Various devices have been provided in commercial cookers to indicate a high temperature of the actual cooking surface. It has been proposed to provide an electronic timer which energises a warning light as soon as a heater is switched on and which keeps the warning light illuminated for a predetermined length of time after the heater has been switched off. This timer, however, has the disadvantage that it indicates a hazardous temperature even if the heater has been energised for a very short time, for example the heater may have been switched on in error, without the cooking surface reaching a hazardous temperature. This results in the warning light losing credibility and in it being ignored by the user because he knows from experience that the cooking surface has not become hot. However, if the cooking surface has been in use for a longer period, the warning light is necessary. These differences, however, are not always readily discernible to the user, and lead to confusion and to consequent danger to the user.

It has also been proposed to simulate temperature variations in the cooking surface and to operate a warning light switch in response to these simulated temperature changes. However, simulation devices are expensive and bulky, and often require more space than is available inside the cooker housing.

According to a further proposal, a warning light is actuated in direct dependence on the actual temperature of the heater or of the support of the heater. This design necessitates a slow response time because the heater as a whole has first to reach a predetermined temperature before the temperature responsive element operates and switches on the warning light. Auxiliary heaters have therefore been provided to reduce the response time of the temperature responsive element, but this complicates construction and makes manufacture difficult and expensive.

Slow initial response can be improved by exposing the temperature responsive element to the direct heat output of the specific heater, but this does not mean that the switching temperature of the warning light is consistent with the actual temperature of the cooking surface. Moreover, the initial response time is still slower than is desirable for accurate correspondance with the temperature of the cooking surface.

Of the above types of design, only the type in which the warning light is actuated in direct dependence on the temperature of the heater responds to the particular heater to which it is directly connected. However, the other types of design can also be coupled with several heater units, the size and cost of the temperature indicator usually restricting the number to one per cooker. Thus, they cannot indicate precisely which heater is in use and which part of the cooking surface has reached a hazardous temperature. Moreover, electronic timing and switching devices are only suitable if the ambient temperature does not exceed 70° C. and therefore such devices need to be installed in specially cooled positions inside the cooker, which of course, results in increased cost.

SUMMARY OF THE INVENTION

According to the present invention there is provided an electric cooker comprising:

a cooking surface;

one or more heaters arranged on the underside of the cooking surface, the or each heater comprising a heating element mounted in a housing comprising a base and an upwardly extending outer rim, the upper edge of the rim being in contact with the underside of the cooking surface so as to form an enclosed chamber between the underside of the cooking surface and the housing, there being formed in the housing an opening to connect the enclosed chamber with the outside of the heater;

a temperature responsive element arranged externally of the enclosed chamber and adjacent to or within the opening such that, on energising the heating element, the temperature responsive element is heated by hot air issuing from the enclosed chamber; and means for indicating when the temperature responsive element is at or above a predetermined temperature.

Thus, the present invention makes it possible to provide a warning system which is of simple construction, safe and reliable, and operates in direct dependence on the surface temperature of the cooking surface; a warning light indicates when a temperature in the range of from 50° to 60° C. has been exceeded. The design also makes it possible for the warning light only to be extinguished when the temperature of the cooking surface has fallen to the abovementioned temperature range and also enables the system to be compact, inexpensive and to be easily installed.

Preferably, the cooking surface is made of glass ceramic and the or each heater is a radiant heater. The base of the or each heater may include a base layer of electrical and thermal insulating material for supporting the heating element. Moreover, the outer rim of the or each heater may include a peripheral rim of electrical and thermal insulating material.

The or each heater may have a thermally conductive outer cover in the form of a metal dish, the temperature responsive element being attached to the metal dish in heat transmissive relation thereto.

In one embodiment of the invention, the or each heater is provided with at least two heating elements, the heating elements being separated from one another by a dividing wall of thermal insulating material so as to form a plurality of enclosed chambers between the underside of the cooking surface and the housing, there being formed in the housing an opening for each chamber, each opening being provided with a temperature responsive element.

The temperature responsive element may comprise a thermocouple, thermistor, resistance thermometer or a bi-metallic switch. For example, the temperature responsive element may comprise a bi-metallic disc positioned to operate a switch. In such a case, the opening may be formed in the outer rim of the housing with a diameter of from 2 to 16 mm, preferably 7 mm, and the temperature responsive element may be secured in front of the opening at a distance of 1 to 10 mm, preferably 2 mm, from the outer rim of the housing. With this arrangement, the response time of the switch can be correlated with the actual surface temperature of the glass ceramic top. The switch is incorporated in an electrical circuit with a warning lamp which indicates when the respective cooking surface is at a hazardous temperature.

It is particularly advantageous if the warning lamp is positioned immediately adjacent to the respective cooking surface below the glass ceramic top, the warning lamp having sufficient intensity to radiate through the glass ceramic top so as to be discernible when it is illuminated. However, it is also possible to arrange the warning lamp in other suitable positions, for example on the front of the cooker, and to provide suitable indication so that the user can distinguish which warning lamp corresponds to each respective cooking surface.

It is also possible to use a thermocouple or a resistance thermometer as the temperature responsive element, the thermocouple or resistance thermometer being positioned, similarly to the bi-metallic switch, in or adjacent to the outlet opening and being connected to a warning lamp in a suitable switching circuit.

In another embodiment of the present invention, the opening may be provided substantially in the centre of the base of the housing and may open into a secondary chamber formed in or on the underside of the housing, the secondary chamber being provided with a temperature responsive element in the form of a thermistor. Preferably, the opening is arranged at or adjacent to one edge of the secondary chamber, the secondary chamber being closed by a cover which is provided with an outlet remote from said opening. It is particularly advantageous if the thermal insulating material and the metal dish of the radiant heater are provided with a recess in the region of the opening from said enclosed chamber to receive the thermistor. This recess should extend laterally adjacent to the opening from said enclosed chamber so that the thermistor is not exposed to direct radiation. The thermistor may be made of a negative temperature coefficient material and suspended in the region of the centre of the secondary chamber, the thermistor being connected in an electrical circuit in series with temperature indicating means in the form of a warning lamp. Alternatively, the thermistor may be made of positive temperature coefficient material and suspended in the region of the centre of the secondary chamber, the thermistor being connected in an electrical circuit in parallel with temperature indicating means in the form of a warning lamp, the parallel circuit being connected to the supply voltage of the heating element by way of a safety resistor.

In cases where the heater is provided with at least two heating elements, there may be provided at least two openings each of which opens into a separate secondary chamber having arranged substantially at the centre thereof a thermistor made of positive temperature coefficient material, the thermistors being connected in series with one another and in parallel with the warning lamp, a resistor being arranged in series with the thermistors and having a resistance such that the voltage drop across the warning lamp when the heating elements are cold remains sufficiently low that the warning lamp is not illuminated. This is particularly advantageous in radiant heaters where the cooking surfaces are augmented by energising further heating elements, for example where a circular or rectangular cooking surface is enlarged by additional peripheral heating elements or where a circular cooking surface is enlarged to form an oval cooking surface by means of additional heating elements arranged laterally of the circular surface.

For a better understanding of the present invention and to show more clearly how it may be carried into effect reference will now be made, by way of example, to the accompanying drawings in which:

DESCRIPTION OF PREFERRED EMBODIMENTS

Figure 1:
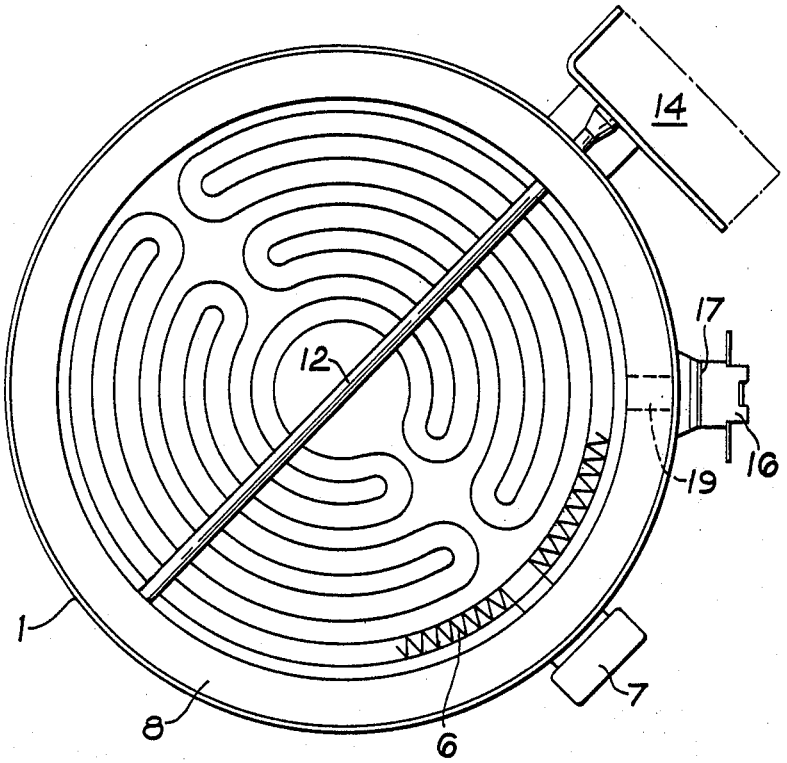
FIG. 1 is a plan view of a radiant heater adapted to be arranged beneath the glass ceramic top of a cooker.
Figure 2:
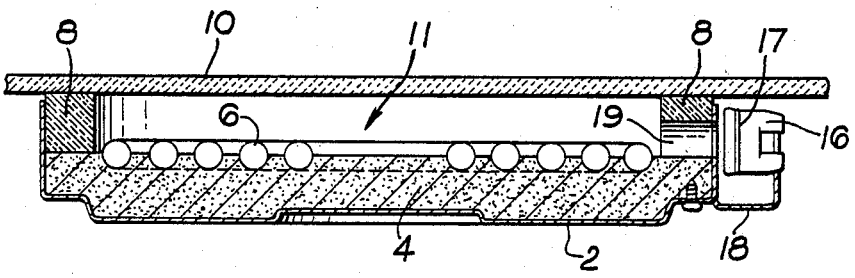
FIG. 2 is a cross-sectional view of the radiant heater taken along line II—II in FIG. 1 and showing the heater arranged beneath the glass ceramic top of a cooker.

FIGS. 1 and 2 show a radiant heater 1 comprising a metal dish 2 containing a base layer 4 of electrical and thermal insulating material which supports a heating element 6 in the form of a helically wound coil of bare wire. Inside the metal dish 2 there is a peripheral rim 8 of electrical and thermal insulating material which lies on the base layer 4. The peripheral rim 8 projects a short distance above the rim of the metal dish 2. The base layer 4 preferably comprises a microporous insulating material such as silica aerogel, an opacifier and, if necessary, reinforcing fibres of alumina or aluminium silicate. The peripheral rim 8 preferably comprises ceramic fibres. However, other insulating materials can also be used for the base layer 4 and the peripheral rim 8. The actual heating element 6 is arranged in a groove formed in the surface of the base layer 4 within the area surrounded by the peripheral rim 8. The heating element is designed in a conventional manner and is arranged such that as even a distribution of heat as possible is obtained. In FIG. 1, the heating element is arranged in a serpentine configuration.

FIG. 2 shows how a radiant heater 1 is arranged beneath the glass ceramic top of a cooker in such a manner that the peripheral rim 8 is in contact with the underside of the glass ceramic top 10 so that an enclosed chamber 11 is produced between the actual heating element 6 and the glass ceramic top 10.

The glass ceramic top 10 forms the smooth cooking surface, within which the actual cooking areas or zones are created by radiant heaters 1 arranged beneath the glass ceramic top. Above the heating element 6, but within the enclosed chamber 11, there is a thermal cut-out 12 to protect against overheating. As shown in FIG. 1, the thermal cut-out 12 extends through an opening in the peripheral rim 8 and co-operates with a mechanical switch 14 which in the event of overheating disconnects the heating element 6 from its power source (not shown). The supply of electrical current to the heater element 6 is by way of a terminal block 7 shown in FIG. 1.

Radiant heaters of this type are known and are manfuactured, for example, by Ceramaspeed Limited, Hadzor Hall, Hadzor, Droitwich, Worcestershire WR9 7DJ, United Kingdom.

However, the radiant heater shown in the figures includes a duct which connects the enclosed chamber 11 within the radiant heater with the region surrounding the radiant heater beneath the glass ceramic top 10. Such a duct 19 in the peripheral rim 8 of the radiant heater is shown in FIG. 2. Outside the radiant heater 1 and immediately in front of the duct 19 there is mounted a temperature-responsive switch 16 which is supported by means of a metal bracket 18. The temperature responsive switch 16 includes a temperature-sensitive element in the form of a bi-metallic disc 17 which overlies the opening of the duct 19 in the peripheral rim of the heater. Thus, air which has been heated in the enclosed chamber 11 is able to pass through the duct 19 to reach the bi-metallic disc 17 of the switch 16. Moreover, the switch 16 is secured to the metal dish 2 by means of a metal bracket 18 so that heat can be conducted from the metal dish 2 to the switch 16. The bracket 18 is shaped and dimensioned such that the bi-metallic disc 17 is arranged at a distance of approximately 2 mm from the adjacent peripheral wall of the metal dish 2. The duct 19 has a diameter of approximately 7 mm with the peripheral rim 8 being approximately 11 mm thick. Suitable temperature-responsive switches 16 are commercially available products and can be obtained, for example, from Therm-O-Disc Inc., Mansfield, Ohio, United States of America.

When the radiant heater 1 is energised by supplying electrical energy to the heating element 6, the heat which is produced is directed primarily onto the underside of the glass ceramic top 10 and causes the glass ceramic to heat up, thereby heating a cooking utensil standing on the upper surface of the glass ceramic top. At the same time, a part of the radiant heat also passes through the duct 19 to the bi-metallic disc 17 of the switch 16. However, radiant heat alone is not sufficient to heat the disc 17 sufficiently quickly to actuate the switch 16 by the time the glass ceramic top in the region of the radiant heater reaches a temperature which could cause burns if the user touches it. It is therefore proposed according to an embodiment of the present invention that the diameter of the duct 19 and the location of the switch 16 are selected such that the air that is heated by the heating element 6 in the enclosed chamber 11 expands, flows out through the duct 19 and impinges on the bi-metallic disc 17 as a stream of hot gas thus actuating the switch 16 so that a warning light connected with the switch, or an equivalent temperature indicating means, is actuated, and it is discernible to the user that the respective cooking surface is hot.

During the time that the radiant heater is energised, the metal dish 2 is heated because part of the heat produced by the heating element 6 passes outwardly through the insulating material 4,8. If the power supply to the heating element 6 is interrupted and the radiant heater cools down, the temperature of the metal dish 2 falls slowly, but by means of the heat-conductive connection between the dish 2 and the switch 16 due to the bracket 18 sufficient heat is transmitted to the bi-metallic disc 17 of the switch 16 by means of conduction or radiation that the switch remains in its actuated state and the warning lamp connected to it remains alight for a transitional period. The system is co-ordinated such that the switch 16 extinguishes the light connected to it after a period sufficient for the cooking surface of the glass ceramic top 10 to have reached an adequately low temperature, i.e. a temperature that is safe for the user.

The duct 19 extending through the peripheral rim 8 and the metal dish 2 can be arranged at any convenient point around the peripheral rim, but it is preferred that the position is selected such that there is no spatial conflict between the terminal 7 and the mechanical switch 14 outside the metal dish 2. It is, of course, also possible to provide the duct 19 in a position other than in the peripheral rim 8 by providing a corresponding duct or gap through the base layer 4. The switch 16 is not then positioned adjacent to the side of the radiant heater 1, but is beneath the heater. However, this alternative arrangement does not affect operability because this depends on the switch 16 being actuated sufficiently quickly during the heating-up phase of the bi-metallic disc 17 by means of the stream of hot air, and during the cooling-down phase a sufficiently delayed deactuation of the switch 16 is accomplished due to conduction to the switch of residual heat in the heater. Actuation of the switch 16 is predetermined such that a warning light connected to the switch lights up to indicate that the relevant cooking surface has a temperature which is dangerous for the user of the cooker to touch when the temperature of the cooking surface reaches 50°-60° C. Actuation of the switch depends on the diameter of the duct 19, the distance of the bi-metallic disc 17 from the opening of the duct, and on the size of the radiant heater. However, these details can be determined by straightforward experiments which require no inventive skills.

Figure 3:
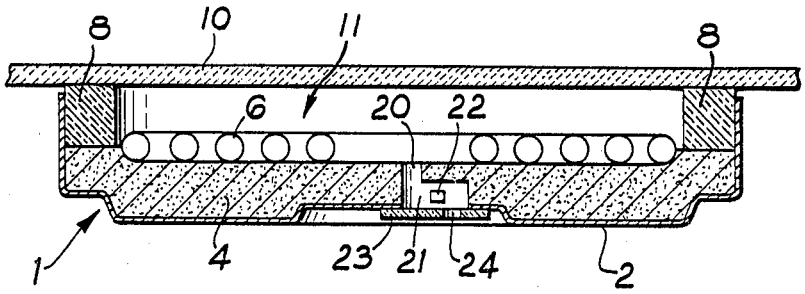
FIG. 3 is a cross-sectional view similar to FIG. 2 and showing an alternative embodiment of heater.

A further embodiment of the invention is shown in FIG. 3, in which a duct 20 extends through the base layer 4. The base layer 4 is typically 15 mm thick and the diameter of the duct 20 may be, for example, 5 mm. At the outward end of the duct 20, i.e. adjacent to the metal dish 2, the diameter is enlarged to provide a recess which may be, for example, 12 mm in diameter and 6 mm in depth. Naturally, the aperture in the metal plate is also enlarged accordingly. The recess is closed by means of a cover 23 so as to form a secondary chamber 21 in the base layer 4. The cover 23 is provided with an outlet opening 24 which is set laterally as far away as possible from the opening of the duct 20 into the secondary chamber 21. Thus the outlet opening in the cover may be arranged to be adjacent to one edge of the secondary chamber 21, whereas the opening of the duct 20 may be arranged to be adjacent to the edge of the secondary chamber 21 substantially diametrically opposite the opening in the cover. The cover is made of a high-temperature resistant insulating material, for example, mica or a ceramic material. The opening 24 in the cover typically has approximately the same diameter as the diameter of the duct 20, but the diameter of the opening 24 can be increased or decreased if this is found to be necessary or desirable.

In the embodiment according to FIG. 3, a thermally-responsive element, for example a thermistor 22, is arranged in the secondary chamber 21. Where a thermistor is used, this is made of a ceramic material, the electrical resistance of which has a positive (PTC) or negative (NTC) temperature coefficient. Thermistors of both these types are commercially available. Thermistors have a temperature threshold, above which the characteristics of the material alter. For this reason, a thermistor 22 must be placed inside the secondary chamber 21 in a position such that the thermistor is not subjected to overheating. It has been shown in practice that the critical temperature threshold for such thermistors is at approximately 300° C., so that the thermistor must not be exposed to direct radiant energy from the heating element 6. This is achieved in the embodiment according to FIG. 3 by placing the thermistor 22 inside the secondary chamber 21 such that it is off-set laterally relative to the opening of the duct 20. In this way, the hot air entering the secondary chamber 21 from the enclosed chamber 11 through the duct 20 circulates around the thermistor 22 and flows out through the opening 24. The necessary electrical connections to the thermistor 22 are not shown, but pass through the cover 23 and can serve directly to support and position the thermistor in the secondary chamber 21. When the radiant heater 1 is energised, the air in the enclosed chamber 11 is heated and expands, producing a stream of hot air which flows past the thermistor 22 and heats the thermistor very quickly.

Figure 4:
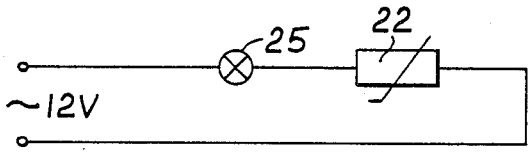
FIGS. 4 and 5 show circuit diagrams of the warning lamps used to indicate a raised temperature of the cooking surface.

If the thermistor 22 is made of a material having a negative temperature coefficient (NTC), the electrical circuit arrangement is as shown in FIG. 4. The thermistor 22 is incorporated into an electrical circuit in series with a warning light which has a filament of predetermined electrical resistance and the circuit is connected to a power source, for example 12 volt alternating current. The resistance of the thermistor 22 is sufficiently high (for example 4700 ohms) so that when the radiant heater is cold, the current flowing through the circuit is sufficiently low not to cause the lamp 25 to light up. As the radiant heater begins to heat up, the thermistor also heats up due to the outflow of hot air so that the electrical resistance of the thermistor decreases accordingly and the flow of current in the electrical circuit increases. As the temperature rises, the electrical resistance of the thermistor falls progressively so that initially the lamp emits light of low intensity, but the intensity of the light increases as the temperature rises. When the radiant heater reaches a stable temperature, the lamp 25 then emits light of a constant intensity. The electrical resistance of the circuit is predetermined by routine experiments so that the lamp 25 shines visibly and serves as a warning when a surface temperature of approximately 50° to 60° C. has been reached on the upper surface of the glass ceramic top 10.

Once the heating element 6 has been switched off, the remaining radiant heat emitted by the insulating material 4 is sufficient to delay the cooling of the thermistor 22 so that the electrical resistance of the thermistor only reaches a level such that the light is no longer visible to the observer when the temperature of the upper surface of the glass ceramic top 10 has fallen to approximately 50° to 60° C. Such a surface temperature is no longer hazardous to the user. The brightness of the lamp 25 is therefore directly proportional to the temperature of the upper surface of the glass ceramic top in the region of the respective radiant heater 1.

Figure 5:
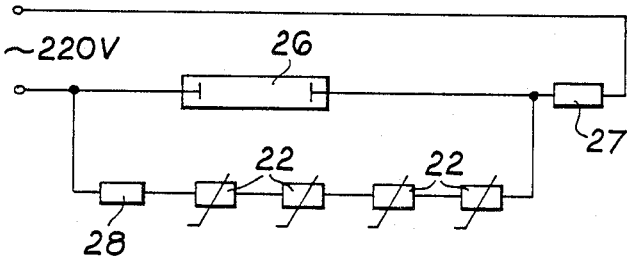

FIG. 5 shows an alternative circuit arrangement for the thermistor. In the circuit shown in FIG. 5, a thermistor is made of a material having a positive temperature coefficient (PTC) and is connected in parallel with a luminous discharge lamp, for example a neon lamp. The circuit shown in FIG. 5 is particularly preferred if radiant heaters with more than one heating element are used, thus involving the use of more than one thermistor for each heater, although in some applications it may in any event be preferred to avoid the use of filament lamps. When the radiant heater is energised and the temperature rises, the electrical resistance of the thermistor increases so that the voltage drop across the neon lamp 26 increases and when a voltage drop of approximately 180 Volts is reached the lamp fires and glows. Similarly, during cooling, the electrical resistance of the thermistor decreases and the neon lamp is extinguished when the voltage drop falls below the stabilised voltage of the lamp (approximately 150 Volts). A resistor 27 is incorporated in the circuit to limit the flow of current through the lamp when the lamp is alight and a resistor 28 is arranged in series with the thermistor 22 to prevent an excessive flow of current when the thermistor 22 is cold. The circuit arrangement shown in FIG. 5 is connected to a power source of 220 Volts alternating current, so that conventional discharge lamps can be used. The resistance of the protective resistors 27 and 28 is such that, depending on the electrical resistance of the thermistor 22, they effectively limit the flow of current in the circuit while ensuring that the lamp glows when the upper surface of the glass ceramic top becomes hot.

FIG. 3 shows a radiant heater 1 with a single heating element 6. However, the present invention is applicable also to radiant heaters having more than one heating element. Radiant heaters of this type are described in U.S. patent application No. 118,951. These are radiant heaters having several heating elements within the heater such that at least one of the heating elements can be energised independently of the other element or elements and can be combined to create larger cooking surfaces. This increase in area can be achieved by a smaller circular heating element being surrounded by one or more annular auxiliary elements, or by one or two crescent-shaped heating elements being arranged laterally adjacent to a circular heating element to form an oval cooking surface. Because the individual heating elements are separated from one another by dividing walls, a number of enclosed chambers are formed between the radiant heater and the glass ceramic top. Thus it is possible, according to the present invention, to provide a corresponding auxiliary temperature sensor for each individual heating element to ensure that when one or all of the heating elements are energised, the respective warning lamp connected thereto indicates the raised temperature of the cooking surface. It is preferable that the duct for the central heating element extends through the base layer 4 and that the duct for the auxiliary heating element surrounding the central element extends through the peripheral rim 8. Where a thermistor or the like is used, a corresponding secondary chamber 21 is formed in the peripheral rim 8. However, it is also possible to provide a bi-metallic switch on the peripheral rim and to combine this with another thermally responsive element, e.g. a thermistor. For technical reasons it is preferable if all the thermally responsive elements in a radiant heater having several heating elements are of the same type, but this is not essential.

Figure 6:
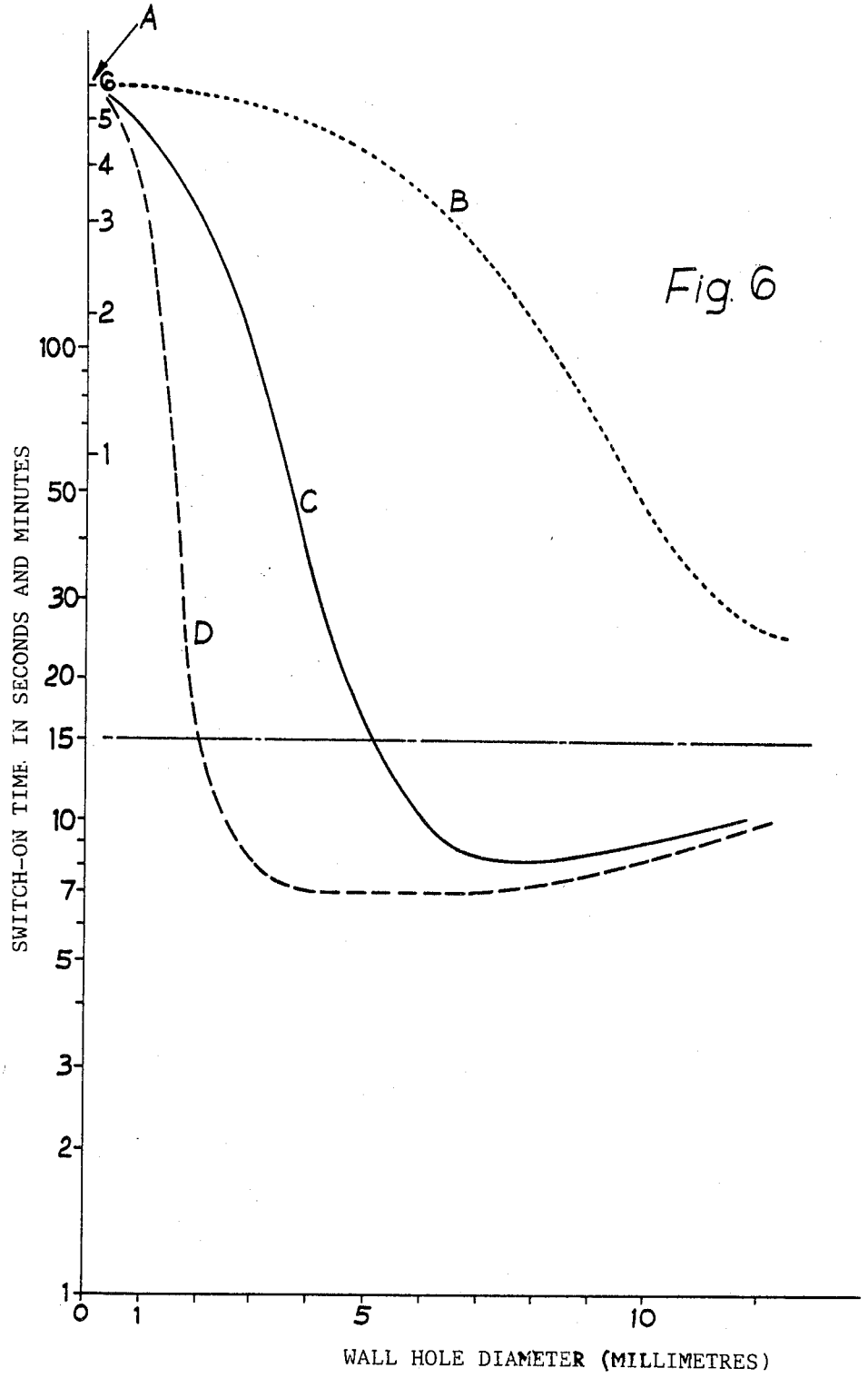
FIG. 6 is a graph, showing the relationship of the response time of a temperature-responsive switch with the size of opening in the peripheral rim of the heater.

FIG. 6 is a graph which shows the relationship between the response time of a temperature-responsive switch incorporating a bi-metallic disc, the diameter of the duct in the thermal insulating material, and the position of the switch. In a glass ceramic top cooker, the upper surface of the glass ceramic top reaches a temperature of 55° C. in approximately 15 seconds. This is the temperature at which the warning light should respond to avoid any hazard to the user of the cooker. For comparison purposes, point A represents the response time of a switch when there is no duct to the enclosed chamber of the radiant heater and the transmission of heat to the switch takes place solely through the metal dish.

Curve B shows the response time of the switch relative to the diameter of the duct, when the duct is covered by a mica window. Curve C shows the response time with an open duct and with the switch arranged a short distance in front of the duct, so that the hot air flowing out of the duct impinges on the bi-metallic disc and heats it accordingly. Curve D shows the response time when the outlet of the duct is almost closed by the bi-metallic disc of the switch. It can be seen from FIGS. 1 to 3 that for practical purposes the diameter of the duct should be no greater than 12 mm. If the switch is fitted a short distance in front of the opening of the duct, for example from 2 to 4 mm, duct diameters of 5 to 10 mm are sufficient to ensure that the switch responds when a temperature of 55° C. is reached on the upper surface of the glass ceramic top and that the respective warning lamp lights up. If the switch is located a very short distance in front of the opening of the duct, for example such that the opening is covered by the bi-metallic disc, correspondingly smaller diameters are sufficient to achieve the desired quick response time, which should be in the region of 15 seconds. On the other hand, the location of the thermally responsive element is to be selected such that during the cooling down phase there is sufficient, but not too long, delay and that the warning light is switched off when the temperature of the upper surface of the glass ceramic top falls below 55° C.

Similar curves to those shown in FIG. 6 for a temperature-responsive switch with a bi-metallic disc can be produced for the use of thermistors. In such cases, the size of the thermistor and its location or the size of the chamber in which the thermistor is located should be included in the relationship. However, it is important for the diameters of the openings to be proportioned so that a sufficiently rapid transmission of heat from the hot air flowing past the thermistor causes the thermistor to respond sufficiently quickly during the heating up phase and so that sufficient heat is transmitted from the surroundings during the cooling down phase to achieve the desired delay effect. In practice, it has been found that the openings can have diameters of from 2 to 12 mm and that the recess to receive the thermistor can have a depth of from 10 to 15 mm and a diameter of from 15 to 30 mm.

I claim:

1. An electric cooker comprising:

a cooking surface;

at least one heater arranged on an underside of the cooking surface, said at least one heater comprising:

a housing comprising a base and an upwardly extending outer rim, the rim having an upper edge which is in contact with the underside of the cooking surface so as to form an enclosed chamber between the underside of the cooking surface and the housing;

a heating element mounted in the housing;

a thermal cut-out to protect against overheating of the cooking surface, which thermal cut-out extends through a first opening in the outer rim and passes above the heating element;

a mechanical switch co-operable with the thermal cut-out to deenergise the heating element in the event of overheating; and a second opening formed in the housing to connect the enclosed chamber with the outside of the heater;

a temperature responsive element arranged externally of the enclosed chamber and positioned relative to said second opening such that, on energising the heating element, the temperature responsive element is heated by hot air issuing from the enclosed chamber by way of said second opening so that the temperature of the temperature responsive element is representative of the temperature of the cooking surface; and means for indicating when the temperature responsive element is at at least a predetermined temperature.

2. An electric cooker as claimed in claim 1, wherein the cooking surface is made of glass ceramic and said at least one heater is a radiant heater unit.

3. An electric cooker as claimed in claim 1, wherein said at least one heater has a thermally conductive outer cover in the form of a metal dish, the temperature responsive element being attached to the metal dish in heat transmissive relation thereto.

4. An electric cooker as claimed in claim 1, wherein the base of said at least one heater includes a base layer of electrical and thermal insulating material for supporting the heating element.

5. An electric cooker as claimed in claim 1, wherein the outer rim of said at least one heater includes a peripheral rim of electrical and thermal insulating material.

6. An electric cooker as claimed in claim 1, wherein said at least one heater includes at least two heating elements, the heating elements being separated from one another by a dividing wall of thermal insulating material so as to form a plurality of enclosed chambers between the underside of the cooking surface and the housing there being formed in the housing one of said second openings for each chamber, each second opening being provided with a temperature responsive element.

7. An electric cooker as claimed in claim 6, wherein the opening is provided substantially in the centre of the base of the housing and opens into a secondary chamber formed in the underside of the housing, the secondary chamber being provided with a temperature responsive element in the form of a thermistor.

8. An electric cooker as claimed in claim 7, wherein the opening is arranged in the region of one edge of the secondary chamber, the secondary chamber being closed by a cover which is provided with an outlet remote from said opening.

9. An electric cooker as claimed in claim 7, wherein the thermistor is made of a negative temperature coefficient material and is suspended in the region of the centre of the secondary chamber, the thermistor being connected in an electrical circuit in series with temperature indicating means in the form of a warning lamp.

10. An electric cooker as claimed in claim 7, wherein the thermistor is made of a positive temperature coefficient material and is suspended in the region of the centre of the secondary chamber, the thermistor being connected in an electrical circuit in parallel with temperature indicating means in the form of a warning lamp, the parallel circuit being connected to a supply voltage of the heating element by way of a safety resistor.

11. An electric cooker as claimed in claim 10, wherein the heater includes at least two heating element, there being provided at least two openings each of which opens into a separate secondary chamber having arranged substantially at the centre thereof a thermistor made of positive temperature coefficient material, the thermistors being connected in series with one another and in parallel to the warning lamp, a resistor being arranged in series with the thermistors and having a resistance such that the voltage drop across the warning lamp when the heating elements are cold remains sufficiently low that the warning lamp is not illuminated.

12. An electric cooker as claimed in claim 1, wherein the temperature responsive element comprises a thermistor.

13. An electric cooker as claimed in claim 1, wherein the temperature responsive element comprises a bi-metallic disc positioned to operate a switch.

14. An electric cooker as claimed in claim 1, wherein said second opening is formed in the outer rim of the housing and has a diameter of from 2 to 16 mm and the temperature responsive element is secured in front of said second opening at a distance of from 1 to 10 mm from the outer rim of the outer rim of the housing.

15. An electric cooker as claimed in claim 1, wherein said second opening has a diameter of substantially 7 mm and the temperature responsive element is secured in front of said second opening at a distance of substantially 2 mm from the outer rim of the housing.

16. An electric cooker as claimed in claim 1, wherein the temperature responsive element is arranged adjacent to said second opening.

17. An electric cooker as claimed in claim 1, wherein the temperature responsive element is arranged within said opening.

18. An electric cooker comprising:

a glass ceramic cooking surface;

at least one radiant heater arranged on an underside of the cooking surface, said at least one heater comprising:

a housing comprising a thermally conductive outer cover in the form of a metal dish;

a base layer of electrical and thermal insulating material arranged in the metal dish;

a peripheral rim of electrical and thermal insulating material arranged in the metal dish and extending upwardly from said base layer, the peripheral rim having an upper edge which is in contact with the underside of the cooking surface so as to form an enclosed chamber between the underside of the cooking surface and the housing;

a heating element mounted on said base layer;

a thermal cut-out to protect against overheating of the cooking surface, which thermal cut-out extends through a first opening in the peripheral rim and passes above the heating element;

a mechanical switch co-operable with the thermal cut-out to deenergise the heating element in the event of overheating; and a second opening formed in the housing to connect the enclosed chamber with the outside of the heater;

a temperature responsive element arranged externally of the enclosed chamber and positioned relative to said second opening such that, on energising the heating element, the temperature responsive element is heated by hot air issuing from the enclosed chamber by way of said second opening so that the temperature of the temperature responsive element is representative of the temperature of the cooking surface; and means for indicating when the temperature responsive element is at at least a predetermined temperature.

* * * * *